United States Patent [19]

Satoh

[11] 4,451,951

[45] Jun. 5, 1984

[54] ENGINE-DRIVEN BLOWER/DUST COLLECTOR

[75] Inventor: Masatoshi Satoh, Tokyo, Japan

[73] Assignee: Kioritz Corporation, Tokyo, Japan

[21] Appl. No.: 418,153

[22] Filed: Sep. 15, 1982

[51] Int. Cl.[3] ..... A47L 9/08

[52] U.S. Cl. ..... 15/330; 15/405

[58] Field of Search ..... 15/330, 405

[56] References Cited

U.S. PATENT DOCUMENTS

| | | | |
|---|---|---|---|
| 2,623,234 | 12/1952 | Brown | 15/330 |
| 2,788,936 | 4/1957 | Kemnitz | 15/330 |
| 3,924,291 | 12/1975 | Tschudy et al. | 15/330 |
| 4,223,419 | 9/1980 | Sato et al. | 15/327 |
| 4,290,165 | 9/1981 | Hiramatsu et al. | 15/330 |
| 4,299,605 | 11/1981 | Aiyama et al. | 55/370 |
| 4,325,163 | 4/1982 | Mattson et al. | 15/330 |

*Primary Examiner*—Philip R. Coe
*Assistant Examiner*—Michael Knick
*Attorney, Agent, or Firm*—Karl W. Flocks; Sheridan Neimark

[57] ABSTRACT

An engine driven blower/dust collector in which the suction opening and the discharge opening are arranged in the same plane in a side-by-side relation, and an air-switching slide pipe is provided to slide on the plane of these openings so as to permit the blower/dust collector to operate selectively as desired as a blower for blowing off and drifting together dust or the like and as a vacuum dust collector for collecting the dust or the like.

1 Claim, 6 Drawing Figures

ENGINE-DRIVEN BLOWER/DUST COLLECTOR

BACKGROUND OF THE INVENTION

The present invention relates to an engine-driven blower/dust collector and, more particularly, to an engine-driven blower/dust collector of back or shoulder bearing type usable both as a blower for drifting or blowing off of dust by the air discharged from the blower and as vacuum dust collector for collecting dust, fallen leaves, waste paper or the like by a combination of a vacuum sucking force generated in a suction pipe connected to the suction side of the blower and a dust colecting bag connected to the discharge side of the blower.

Hitherto, the apparatus of the kind mentioned above has been constructed either as a blower or a dust collector so that various troublesome work has been required for the cleaning and exchange of the attachments.

BRIEF SUMMARY OF THE INVENTION

Accordingly, it is a primary object of the invention to provide an improved engine-driven blower/dust collector capable of overcoming the above-described problems of the prior art. Namely, the invention aims at providing an engine-driven blower/dust collector which can easily be used both as blower and dust collector thanks to a combination of an improved fan case and an air-switching slide pipe.

Namely, according to the invention, there is provided an engine-driven blower/dust collector in which the suction opening and the discharge opening of a blower is disposed in a common plane, and an air-switching slide pipe is disposed slidably on these openings in such a manner as to permit the use of the blower/dust collector selectively either as a blower or a dust collector.

More specifically, the invention provides an engine-driven blower/dust collector comprising: an engine having a shaft; a fan directly connected to the shaft; a fan case accomodating the fan; a partition wall dividing the internal space of the fan case in the axial direction into two sections and having an opening opposing to the central portion of the fan, the axially outer section constituting a suction chamber for the fan while the axially inner section constituting a discharging chamber for the fan; an opening surface having openings and arranged in a common plane and communicated with the suction chamber and discharge chamber, respectively, the opening surface being formed in the peripheral wall of the fan case; an air-switching slide pipe slidable on the opening surface so as to select one or both of the openings in the opening surface; and means for connecting a nozzle pipe, dust collecting pipe or the like to the end of the air-switching slide pipe remote from the opening surface.

These and other objects, features and advantages of the invention will become clear from the following description of the preferred embodiment taken in conjunction with the accompanying drawings.

BRIEF DESCRIPTION OF THE DRAWINGS

The attached drawings in comnbination show a preferred embodiment of the invention in which.

DESCRIPTION OF THE PREFERRED EMBODIMENT

The invention will be fully understood from the following description of the preferred embodiments taken in conjunction with the accompanying drawings.

The attached drawings in combination show an engine-driven blower/dust collector of back bearing type, constructed in accordance with an embodiment of the invention.

The engine-driven blower/dust colector has an engine 1 having a shaft 2 to which directly connected is a fan 3 encased by a fan case 4 which is constructed as a unit with the engine 1.

Figure 2:
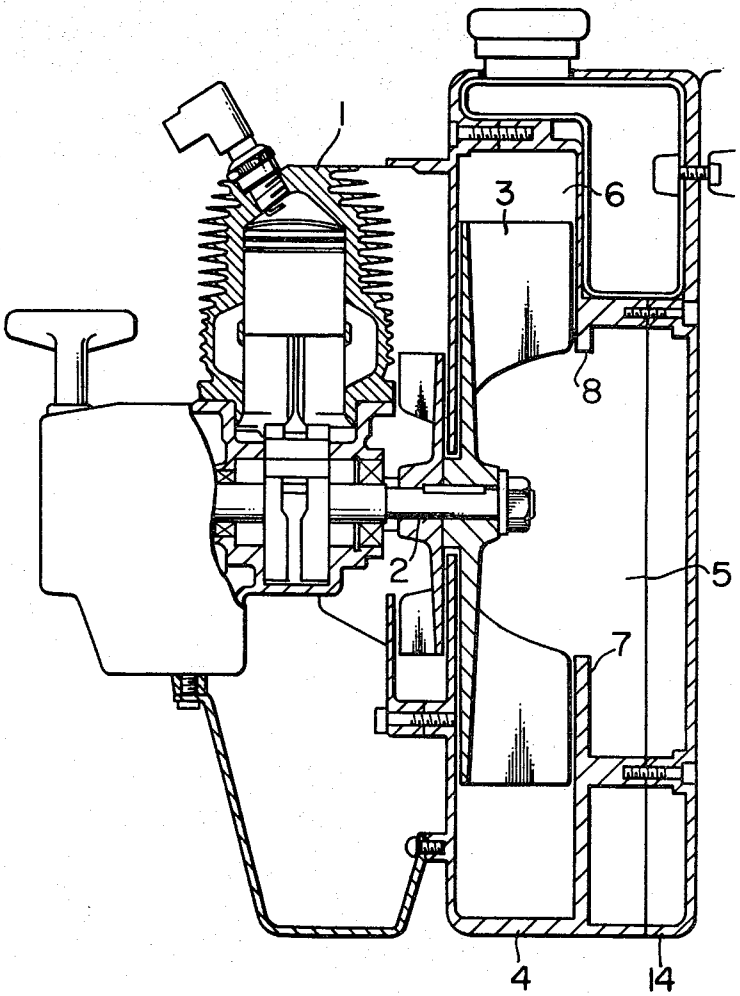
FIG. 2 is a sectional view taken along the line II—II of FIG. 1.
Figure 1:
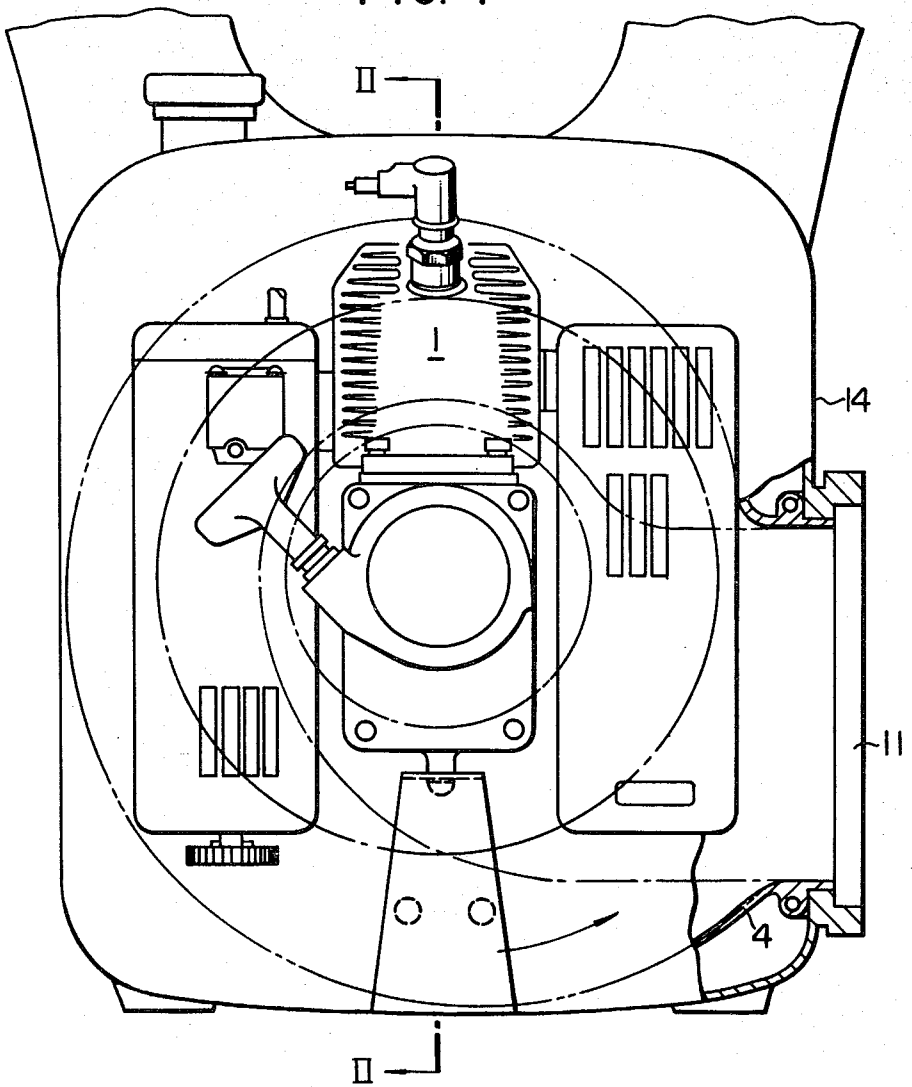
FIG. 1 is a front elevational view of an engine-driven blower/dust-collector in accordance with an embodiment of the invention.
Figure 4:
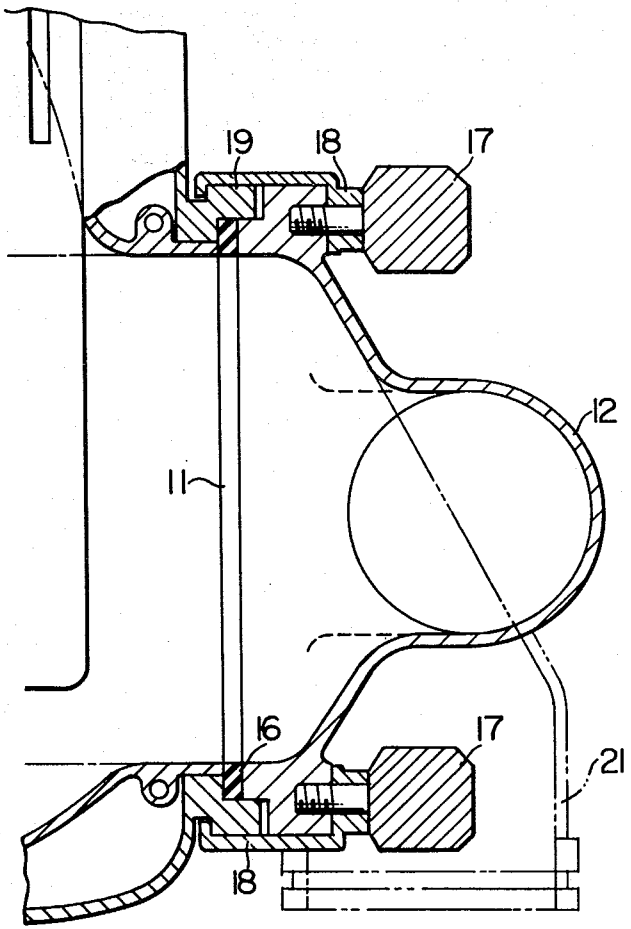
FIG. 4 is a sectional view taken along the line IV—IV of FIG. 3.
Figure 5:
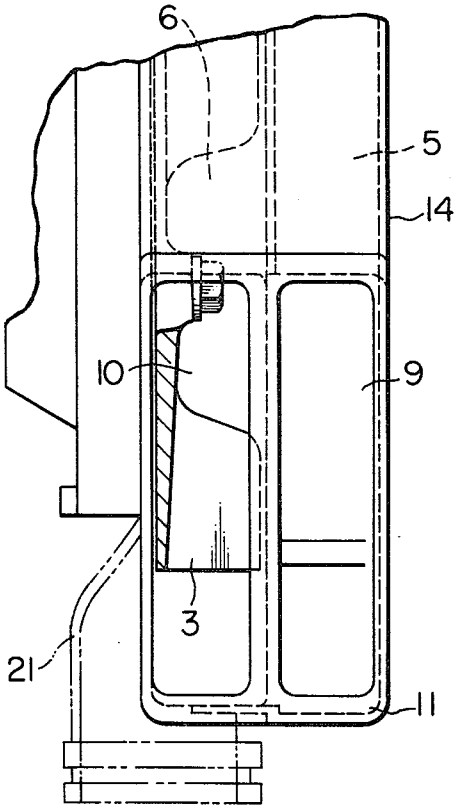
FIG. 5 is a front elevational view of a discharge port of a fan case.

The fan case 4 has a substantially symmetrical outer shell 14. As will be seen from the sectional view shown in FIG. 2, the internal space of the fan case 4 is divided in the direction of the axis of the shaft 2 into two sections: namely, an outer section 5 and an inner section 6. These sections are opened to the outside through openings 9 and 10 formed in the peripheral wall of the fan cae 4 as will be best seen from FIG. 5. An opened surface 11 is formed in the same plane. An inlet opening 8 opposing to the central portion of the fan 3 is formed in the central portion of a partition wall 7 which separates the two sections 5 and 6 from each other. The arrangement is such that the air is sucked through the opening 9 constituting the suction opening and then through the aforementioned inlet opening 8. The air pressurized by the fan 3 is then discharged from the aforementioned opening 10 constituting the discharge opening and arranged in a side-by-side relation to the suction opening 9. As shown in FIG. 4, the openings 9 and 10 are arranged in the same plane constituting the opening surface 11. The engine-driven blower/dust collector of the invntion, therefore, can operate either in sucking mode, i.e. in the dust sucking mode and in discharging mode, i.e. in the dust blowing mode, by a provision of an air-switching slide pipe 12 adapted to slide on the opening surface 11 to select one of the suction opening 9 and the discharge opening 10.

The air-switching slide pipe 12 can be mounted in any desired manner. In the illustrated embodiment, the air-switching slide pipe 12 is secured to the opening surface 11 through the medium of a packing 16 and fastened to a flange portion 19 formed around the opening in the outer shell 14 by means of screws 17,17 through retainers 18,18, as will be seen from FIG. 4.

Figure 6:
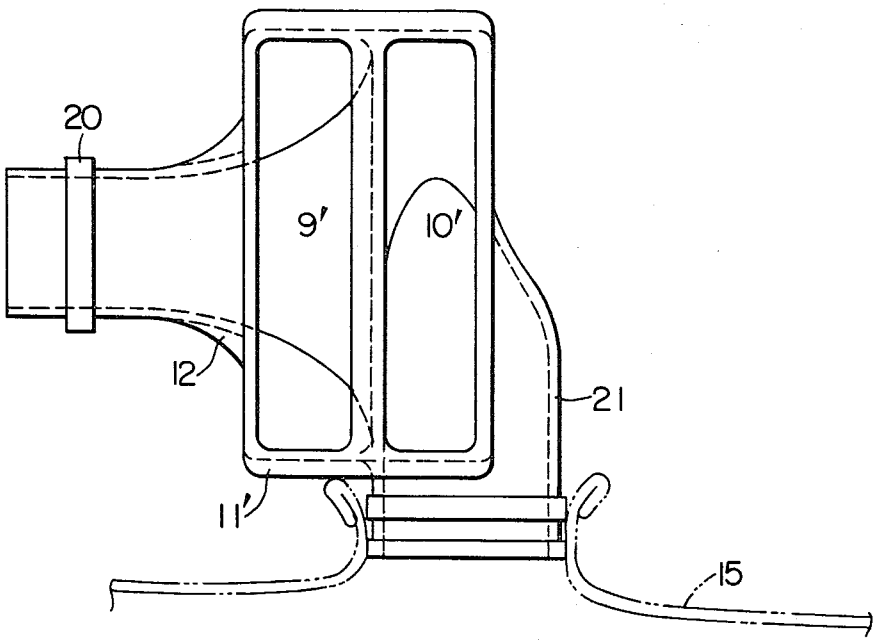
FIG. 6 is a front elevational view showing the sliding surface of an air-switching slide pipe.

FIG. 6 shows the detail of the air-switching slide pipe 12. The air-switching slide pipe 12 has an opening surface 11' having openings 9',10' formed in the common plane in a side-by-side relation and engaging with the opening surface 11 of the fan case 4 by means of a dovetail joint or the like. The air-switching slide pipe 12 is slidable to select one or both of the suction opening 9 and the discharge opening 10.

Assuming here that the air-switching slide pipe 12 takes such a position that the openings 9',10' oppose to the suction opening 9 and discharge opening 10, respectively, air is sucked through a nozzle 20 of the air-switching slide pipe 12 and then through the openings 9' and 9. The air, which is made to pass through the sections 5 and 6, is then discharged from a nozzle 21 via the openings 10 and 10'. Thus, the engine-driven blower/-dust collector operates in this state as a dust collector, with the assist of a dust sucking pipe 13 connected to the nozzle 20 and a dust collecting bag 15 connected to the nozzle 21. Namely, dust is sucked through the nozzle 20 and is collected in the dust collecting bag 15, while being conveyed by the flow of air.

Figure 3:
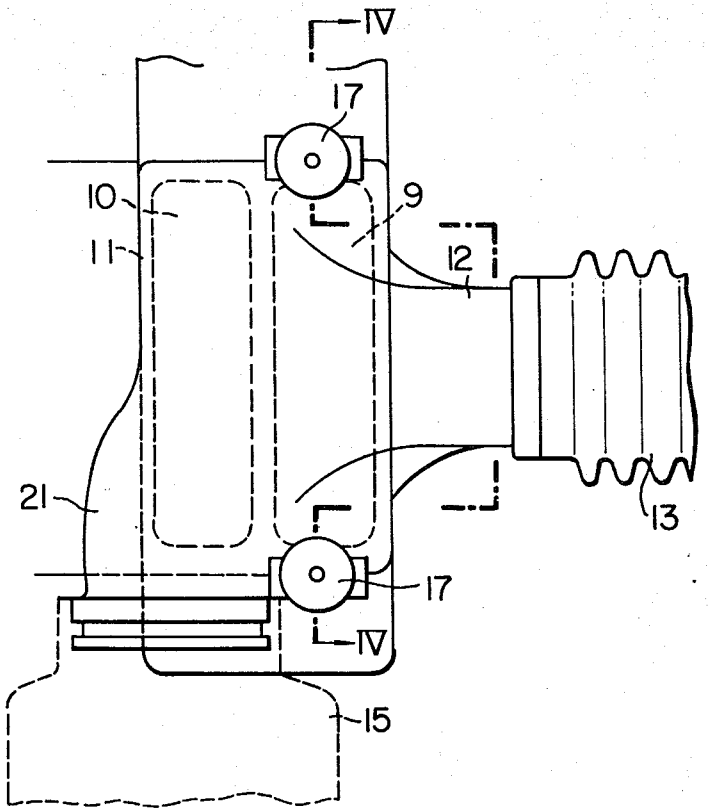
FIG. 3 is a side elevational view of an essential part, particularly a discharge opening and portion therearound, in the engine-driven blower/dust-collector.

Then, as the air-switching slide pipe 12 is moved to the left as viewed in FIG. 3, the opening 9' is brought into alignment with the opening 10. In consequence, the opening 9 is allowed to open directly to the outside through the opening 9' in the air-switching slide pipe 12. In this state, thereofre, the nozzle 20 serves as a discharge pipe, and it is possible to blow off and drift the dust together by the flow of air jetted from an air blowing nozzle attachment (not shown) attached to the nozzle 20. In this state, the nozzle 21 has no use.

Although the invention has been described through specific terms, it is to be noted here that the described embodiment is not exclusive and various changes and modifications may be imparted thereto without departing from the scope of the invention which is limited solely by the appended claim.

What is claimed is:

1. An engine-driven blower/dust collector comprising: an engine (1) having a shaft (2); a fan (3) directly connected to said shaft (2); a fan case (4) accommodating said fan (3); a partition wall (7) dividing the internal space of said fan case (4) in the axial direction of said shaft (2) into two sections (5 and 6) and having an opening (8) opposing to the central portion of said fan (3), the axially outer section (5) constituting a suction chamber for said fan (3) while the axially inner section (6) constituting a discharging chamber for said fan (3); an opening surface (11) having openings (9 and 10) arranged in a common plane and communicated with said suction chamber (5) and discharge chamber (6), respectively, said opening surface (11) being formed in the peripheral wall of said fan case (4); an air-switching slide pipe (12) slidable on said opening surface (11) in the axial direction of said shaft (2) so as to select one or both of said openings (9, 10) in said opening surface (11); and means for connecting a dust sucking pipe (13), dust collecting bag (15) or the like to nozzles (20 and 21) communicating to openings (9', 10') of said air-switching slide pipe (12) corresponding to said openings (9, 10) of said opening surface (11).

* * * * *